United States Patent [19]

Shioya et al.

[11] 4,249,504

[45] Feb. 10, 1981

[54] UNITARY ASSEMBLY FOR CONTROL OF EGR APPARATUS FOR ENGINE

[75] Inventors: Toshio Shioya, Urawa; Kiyoshi Ishii, Tachikawa; Hiroyuki Nishimura, Kounosu, all of Japan

[73] Assignee: Honda Giken Kogyo Kabushiki Kaisha, Tokyo, Japan

[21] Appl. No.: 70,027

[22] Filed: Aug. 27, 1979

[30] Foreign Application Priority Data

Sep. 14, 1978 [JP] Japan ..... 53/112186

[51] Int. Cl.[3] ..... F02B 47/08; F02M 25/06

[52] U.S. Cl. ..... 123/568

[58] Field of Search ..... 123/119 A

[56] References Cited

U.S. PATENT DOCUMENTS

| | | | |
|---|---|---|---|
| 3,739,797 | 6/1973 | Caldwell | 123/119 A X |
| 3,779,222 | 12/1973 | Lorenz | 123/119 A |
| 3,818,880 | 6/1974 | Dawson et al. | 123/119 A |
| 3,884,200 | 5/1975 | Caldwell | 123/119 A |
| 3,915,136 | 10/1975 | Caldwell | 123/119 A X |
| 3,970,061 | 7/1976 | Caldwell | 123/119 A |
| 4,033,308 | 7/1977 | Hayashi et al. | 123/119 A |

FOREIGN PATENT DOCUMENTS

| | | | |
|---|---|---|---|
| 1486093 | 9/1977 | United Kingdom | 123/119 A |
| 1486651 | 9/1977 | United Kingdom | 123/119 A |

*Primary Examiner*—Wendell E. Burns

*Attorney, Agent, or Firm*—Lyon & Lyon

[57] ABSTRACT

Exhaust gas recirculation apparatus for an internal combustion engine employs a vacuum responsive control valve in a passageway connecting the engine exhaust passage to the engine intake passage downstream from the throttle valve. A unitary housing comprising a base, a body, and a cap contains an air control valve and a regulating valve each having a flexible diaphragm responsive to differential pressure. The diaphragm for the air control valve is clamped between the cap and the body, and the diaphragm for the regulating valve is clamped between the body and the base. Vacuum pressures on opposite sides of the diaphragm for the air control valve are obtained from a control pipe system and from an air conduit downstream from the air control valve. Vacuum pressures on opposite sides of the diaphragm for the regulating valve are obtained from a vacuum line and from the air conduit upstream from the air control valve. The regulating valve acts to control vacuum pressure in the control pipe system by bleeding vacuum pressure therein through a variable opening into the vacuum line.

4 Claims, 2 Drawing Figures

UNITARY ASSEMBLY FOR CONTROL OF EGR APPARATUS FOR ENGINE

This application is related to co-pending and co-assigned U.S. Pat. Application Ser. No. 9,370 filed Feb. 5, 1979 by Hiroyuki Nishimura, which is incorporated herein by this reference.

This invention relates to improved control apparatus for exhaust gas recirculation in internal combustion engines. It is known to employ an exhaust gas recirculation control valve to control recirculation of exhaust gases into the engine intake passage and to provide a vacuum sensitive actuator for that control valve.

This invention employs an air control valve and a regulating valve each having an actuator sensitive to differential pressures. The air control valve, the regulating valve, and the actuators for each are all contained within a unitary housing. This makes it possible to reduce the overall size and to facilitate assembly. Also, the two valves are enclosed for reliable operation and are located close to each other for improved responsiveness.

An air conduit extends from the engine intake passage downstream from the throttle valve through the air control valve to atmosphere. A vacuum line is connected to the engine intake passage upstream from the throttle valve and communicates with the actuator for the regulating valve. A control pipe system connected to the engine intake passage near the throttle valve communicates with the vacuum sensitive actuator for the exhaust gas recirculation control valve, and it also communicates with the actuator for the air control valve. The regulating valve has a variable opening for bleeding the control pipe system into the vacuum line.

Other and more detailed objects and advantages will appear hereinafter.

Figure 1:
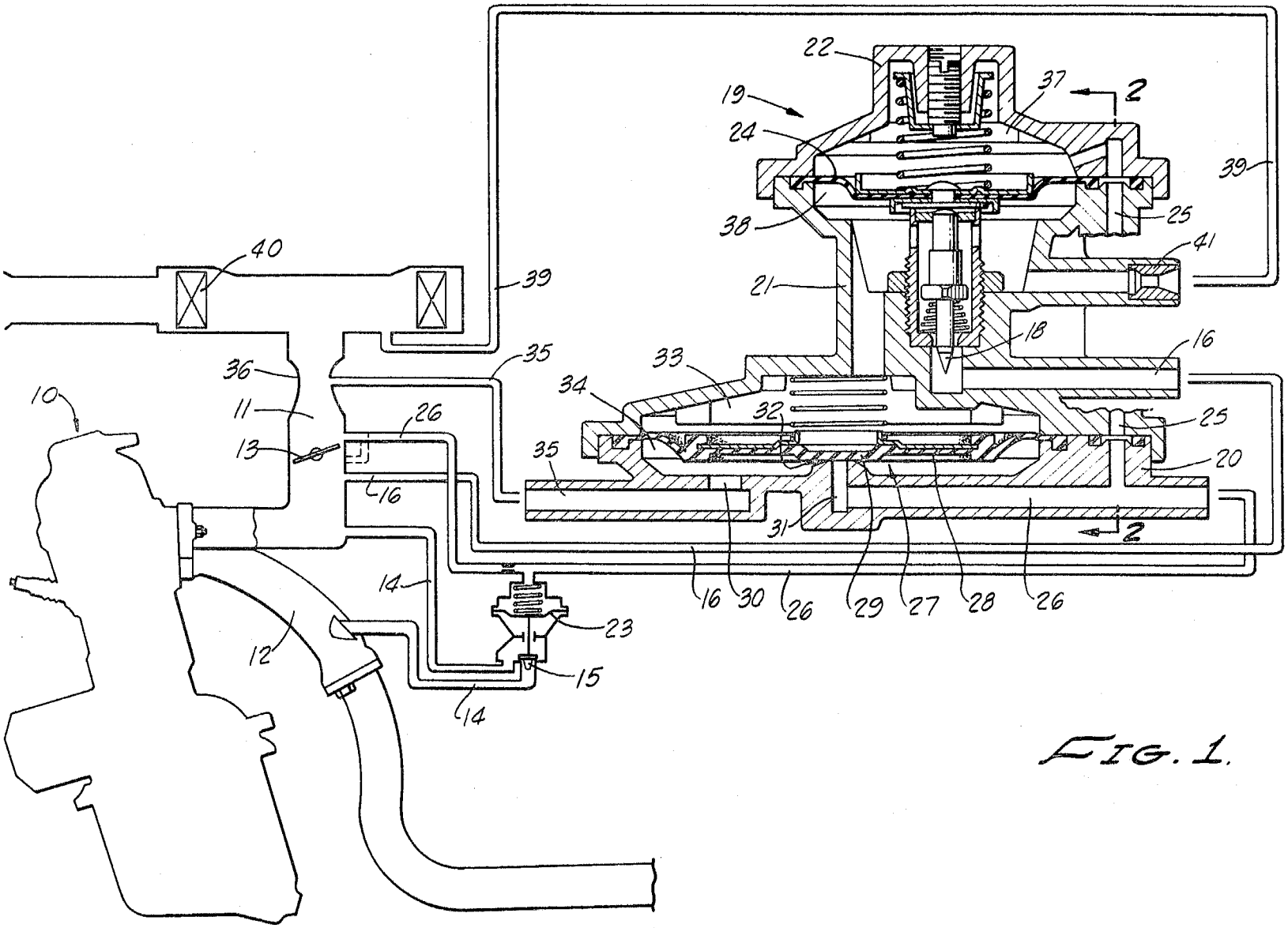
FIG. 1 is a view partly schematic and partly in vertical section showing a preferred embodiment of this invention.

Referring to the drawings, the engine 10 has an intake passage 11 for an air-fuel mixture, and a passage 12 for exhaust gases. A throttle valve 13 is provided in the intake passage 11. A passageway 14 connects the exhaust passage 12 to the intake passage 11 at a location downstream from the throttle valve 13, for recirculating exhaust gases into said engine 10. An exhaust gas recirculation control valve 15 is positioned in this passageway 14.

An air conduit 16 is connected to said intake passage 11 at a location downstream from said throttle valve 13 and has an air control valve 18 mounted therein. A housing generally designated 19 includes a base 20, a body 21 and a cap 22 secured together by fastener means, not shown. The exhaust gas recirculation control valve 15 is provided with a vacuum responsive actuator employing a diaphragm 23. The air control valve 18 is mounted in the body 21 and is provided with a diaphragm 24, its periphery being clamped between the cap 22 and the body 21. Each of these diaphragms 23, 24 is subjected to vacuum pressure in a control pipe system 26, which is connected to the intake passage 11 near the throttle valve 13.

A regulating valve 27 is mounted in the base 20 and provided with a movable diaphragm member 28 having its periphery clamped between the body 21 and the base 20. The diaphragm member 28 is provided with a central non-flexible portion 29. A port 31 forming a part of the control pipe system 26 is closed and opened by contact with the central non-flexible portion 29 of the diaphragm member 28. A variable opening 32 is thus formed between the port 31 and the central portion 29 of the diaphragm member 28. The chamber 33 above the diaphragm member 28 of the regulating valve 27 is subjected to vacuum pressure in the air conduit 16 as modified by the air control valve 18. The chamber 34 below the diaphragm member 28 is connected through opening 30 to a vacuum line 35 which in turn is connected to the intake passage 11 upstream from the throttle valve 13 in the carburetor venturi section 36.

Figure 2:
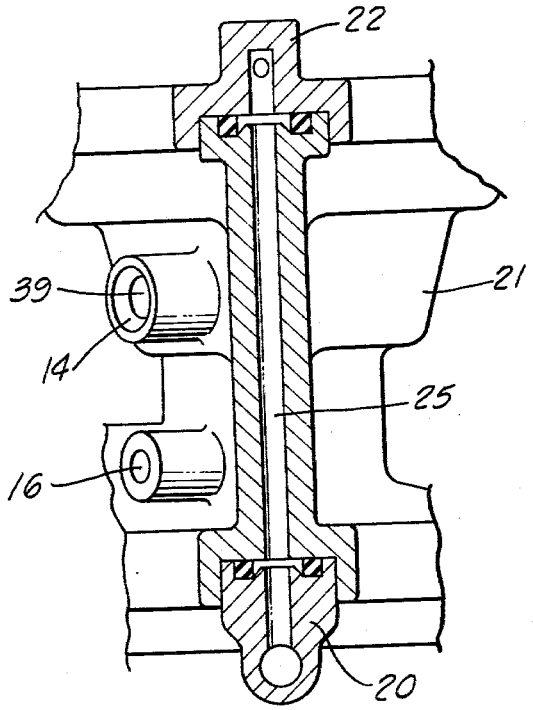
FIG. 2 is a sectional elevation, partly broken away, and taken substantially on the lines 2—2 as shown on FIG. 1.

A branch 25 (see FIG. 2) from the air control line 26 leads to the chamber 27 above the flexible diaphragm 24. The chamber 38 under the diaphragm 24 is subjected to vacuum pressure in the air line 39 leading from the air cleaner 40 and restriction 41. A known sucked air heating device, not shown, is associated with the air line 39 to heat the air moving from the air cleaner 40 to the restriction 41. Moreover, the air control valve 18 is designed to have slight ventilation clearance even in its closed position, whereby previously heated air is kept flowing through the chamber 38 and past the air control valve 18 inside the body 21 of the housing 19. The housing 19 is thus maintained somewhat warm to prevent malfunctioning in the cold season. In operation, the operating vacuum in the control pipe system 26 acts on the diaphragm 23, 24 of the exhaust gas recirculation control valve 15 and the air control valve 18 respectively to open these control valves. Exhaust gases from the exhaust passage 12 are then circulated back to the intake passage 11. At the same time, the air control valve 18 increases the rate of air-flow from the chamber 38 into the line 16 and thus generates a vacuum pressure in the chamber 33. This vacuum pressure in the chamber 33 acts on the upper side of the diaphragm member 28 of the regulating valve 27 to cause the central portion 29 of the diaphragm member 28 to lift away from the variable opening 32. This reduces the vacuum intensity in the control pipe system 26 and serves to move the exhaust gas recirculation control valve 15 toward closed position. Also the vacuum pressure in the vacuum line 35 is introduced into the chamber 34 and acts on the lower side of the diaphragm member 28 to cause the central portion 29 of the diaphragm member 28 to close the variable opening 32.

As will be understood from the foregoing description, the housing 19 comprising the base 20, body 21, and cap 22 makes it possible to have the entire system made relatively smaller and its assembling easier. The two valves 18 and 27 are enclosed for reliable operation and are located close to each other for improved responsiveness.

Having fully described our invention, it is to be understood that we are not to be limited to the details herein set forth but that our invention is of the full scope of the appended claims.

We claim:

1. In an internal combustion engine having an intake passage for delivering an air-fuel mixture into the engine, a throttle valve in the intake passage, and an exhaust passage for carrying exhaust gases from the engine, the improvement comprising, in combination: a passageway connecting the exhaust passage to the intake passage downstream from the throttle valve for recirculating exhaust gases into said engine, an exhaust recirculation valve in said passageway and having a vacuum responsive actuator, a housing comprising a base, a body, and a cap, an air conduit connecting said intake passage downstream from said throttle valve to atmosphere, an air control valve positioned in said air conduit and having an actuator responsive to differential pressure, said air control valve being mounted in said body, a vacuum line connected to said intake passage upstream from said throttle valve, a regulating valve positioned in said base and having an actuator responsive to differential pressure between vacuum pressure in said vacuum line and vacuum pressure in said air conduit upstream from said air control valve, a control pipe system connected to said intake passage near said throttle valve, and means whereby said regulating valve functions through said control pipe system to act upon the vacuum responsive actuator for said exhaust recirculation valve and upon said actuator for said air control valve.

2. The combination set forth in claim 1 in which said regulating valve has a variable opening for bleeding said control pipe system to said vacuum line.

3. In an internal combustion engine having an intake passage for delivering an air-fuel mixture into the engine, a throttle valve in the intake passage, and an exhaust passage for carrying exhaust gases from the engine, the improvement comprising, in combination: a passageway connecting the exhaust passage to the intake passage downstream from the throttle valve for recirculating exhaust gases into said engine, an exhaust recirculation valve in said passageway and having a vacuum responsive actuator, a housing comprising a base, a body, and a cap, an air conduit connecting said intake passage downstream from said throttle valve to atmosphere, an air control valve in said air conduit having a flexible diaphragm responsive to differential pressure, said air control valve being mounted in said body, said diaphragm having its periphery clamped between said body and said cap, a vacuum line connected to said intake passage upstream from said throttle valve, a regulating valve positioned in said base and having a diaphragm with a periphery clamped between said base and said body, said regulating valve being responsive to differential pressure between vacuum pressure in said vacuum line and vacuum pressure in said air conduit upstream from said air control valve, a control pipe system connected to said intake passage near said throttle valve, and means whereby said regulating valve functions through said control pipe system to act upon the vacuum responsive actuator for said exhaust recirculation valve and upon said flexible diaphragm for said air control valve.

4. The combination set forth in claim 3 in which said regulating valve has a variable opening for bleeding said control pipe system to said vacuum line.

* * * * *